US011289013B2

(12) United States Patent
Lin et al.

(10) Patent No.: US 11,289,013 B2
(45) Date of Patent: Mar. 29, 2022

(54) PIXEL CIRCUIT AND DISPLAY DEVICE HAVING THE SAME

(71) Applicant: AU Optronics Corporation, Hsin-Chu (TW)

(72) Inventors: Chih-Lung Lin, Hsin-Chu (TW); Po-Cheng Lai, Hsin-Chu (TW); Ting-Ching Chu, Hsin-Chu (TW); Po-Chun Lai, Hsin-Chu (TW); Mao-Hsun Cheng, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/075,066

(22) Filed: Oct. 20, 2020

(65) Prior Publication Data

US 2021/0125547 A1 Apr. 29, 2021

(30) Foreign Application Priority Data

Oct. 23, 2019 (TW) ..... 108138296

(51) Int. Cl.
*G09G 3/3233* (2016.01)
*G09G 3/32* (2016.01)

(52) U.S. Cl.
CPC ..... *G09G 3/32* (2013.01); *G09G 3/3233* (2013.01); *G09G 2300/0819* (2013.01); (Continued)

(58) Field of Classification Search
CPC ... G09G 3/32–3291; G09G 2300/0809; G09G 2300/0819; G09G 2300/0842; G09G 2300/0871; G09G 2310/0248; G09G 2310/0251; G09G 2310/0262; G09G 2310/0286; G09G 2320/02; (Continued)

(56) References Cited

U.S. PATENT DOCUMENTS 8,502,757 B2 8/2013 Liu et al.
8,564,512 B2 10/2013 Chung
(Continued)

FOREIGN PATENT DOCUMENTS

CN 102956192 A 3/2013
CN 107610640 A 1/2018
(Continued)

*Primary Examiner* — Nathan Danielsen
(74) *Attorney, Agent, or Firm* — WPAT, PC

(57) ABSTRACT

A pixel circuit including a compensation circuit, a writing circuit, a light emitting element, and a power supplying circuit is provided. The compensation circuit comprises a first node, and provides a driving current to the light emitting element according to a voltage of the first node and a system high voltage. The writing circuit provides a data voltage to the compensation circuit according to a first control signal so that the compensation circuit sets the voltage of the first node. The power supplying circuit selectively couples the compensation circuit to the light emitting element, and provides the system high voltage and a system low voltage to the compensation circuit, in which the system low voltage is configured to reset the voltage of the first node. The first control signal and the second control signal are opposite to the first emission signal and the second emission signal, respectively.

8 Claims, 12 Drawing Sheets

(52) U.S. Cl.
CPC ..... *G09G 2300/0842* (2013.01); *G09G 2310/0251* (2013.01); *G09G 2310/0262* (2013.01); *G09G 2310/0286* (2013.01); *G09G 2330/028* (2013.01)

(58) Field of Classification Search
CPC ... G09G 2320/0233; G09G 2320/0242; G09G 2320/0257; G09G 2320/0266; G09G 2320/043; G09G 2320/045
See application file for complete search history.

(56) References Cited

U.S. PATENT DOCUMENTS

| | | | | |
|---|---|---|---|---|
| 9,824,633 | B2 * | 11/2017 | Qing | G09G 3/3233 |
| 2013/0043802 | A1 | 2/2013 | Han et al. | |
| 2013/0314305 | A1 | 11/2013 | Liu et al. | |
| 2014/0176404 | A1 * | 6/2014 | Qian | G09G 3/3233 345/82 |
| 2015/0002557 | A1 * | 1/2015 | Ishii | G09G 3/3233 345/690 |
| 2016/0005359 | A1 * | 1/2016 | Kwon | G09G 3/3266 345/213 |
| 2016/0253963 | A1 * | 9/2016 | Yang | G09G 3/3233 345/211 |
| 2017/0162120 | A1 * | 6/2017 | Hung | G09G 3/3233 |
| 2017/0278457 | A1 * | 9/2017 | Zhu | G09G 3/3233 |
| 2017/0330511 | A1 | 11/2017 | Feng | |
| 2018/0137800 | A1 | 5/2018 | Cheng | |
| 2018/0137806 | A1 | 5/2018 | Cheng | |
| 2018/0137807 | A1 | 5/2018 | Cheng | |
| 2018/0137812 | A1 | 5/2018 | Yan et al. | |
| 2018/0137815 | A1 | 5/2018 | Cheng | |
| 2018/0137816 | A1 | 5/2018 | Cheng | |
| 2018/0138276 | A1 | 5/2018 | Cheng | |
| 2019/0156750 | A1 | 5/2019 | Dong | |
| 2020/0051491 | A1 | 2/2020 | Xuan et al. | |

FOREIGN PATENT DOCUMENTS

| | | | |
|---|---|---|---|
| CN | 110164375 | A | 8/2019 |
| TW | I574247 | B | 3/2017 |
| TW | 201818386 | A | 5/2018 |

* cited by examiner

PIXEL CIRCUIT AND DISPLAY DEVICE HAVING THE SAME

RELATED APPLICATION

This application claims priority to Taiwan Application Number 108138296, filed on Oct. 23, 2019, which is herein incorporated by reference in its entirety.

BACKGROUND

Technical Field

The present disclosure generally relates to a display device. More particularly, the present disclosure relates to a pixel circuit of the display device in which substantially immune to effects caused by leakage currents.

Description of Related Art

Compared with liquid crystal displays (LCDs), organic light-emitting diode (OLED) displays have the advantages of low power consumption, high color saturation and high response speed, making them being regarded as one of the next generation of mainstream display products. OLED displays use transistors operated in the saturation region as current sources to drive OLEDs. However, the OLED pixel circuits usually needs control signals having complex waveforms, and also face problems of leakage currents through thin film transistors (TFTs).

SUMMARY

The disclosure provides a pixel circuit including a compensation circuit, a writing circuit, a light emitting element, and a power supplying circuit. The compensation circuit comprises a first node, and is configured to provide a driving current according to a voltage of the first node and a system high voltage. The writing circuit is configured to provide a data voltage to the compensation circuit according to a first control signal so that the compensation circuit sets the voltage of the first node. The light emitting element is configured to emit light according to the driving current. The power supplying circuit is configured to couple the compensation circuit to the light emitting element according to a first emission signal, is configured to provide the system high voltage to the compensation circuit according to a second emission signal, and is configured to provide a system low voltage to the compensation circuit according to a second control signal to reset the voltage of the first node. The first control signal is opposite to the first emission signal, and the second control signal is opposite to the second emission signal.

The disclosure provides a display device including a gate driving circuit, a pixel array, and a source driving circuit. The gate driving circuit is configured to provide multiple control signals and multiple emission signals, in which the multiple control signals are opposite to the multiple emission signals, respectively. The pixel array is coupled with the gate driving circuit, and comprises multiple pixel circuits. Each of the multiple pixel circuits includes a compensation circuit, a writing circuit, a light emitting element, and a power supplying circuit. The compensation circuit comprises a first node, and is configured to provide a driving current according to a voltage of the first node and a system high voltage. The writing circuit is configured to provide a data voltage to the compensation circuit according to a first control signal of the multiple control signals, so that the compensation circuit sets the voltage of the first node. The light emitting element is configured to emit lights according to the driving current. The power supplying circuit is configured to conduct the compensation circuit to the light emitting element according to a first emission signal of the multiple emission signals, is configured to provide the system high voltage to the compensation circuit according to a second emission signal of the multiple emission signals, and is configured to provide a system low voltage to the compensation circuit according to a second control signal of the multiple control signals so as to reset the voltage of the first node. The source driving circuit is coupled with the pixel array, and is configured to provide the data voltage.

It is to be understood that both the foregoing general description and the following detailed description are by examples, and are intended to provide further explanation of the disclosure as claimed.

DETAILED DESCRIPTION

Figure 1:
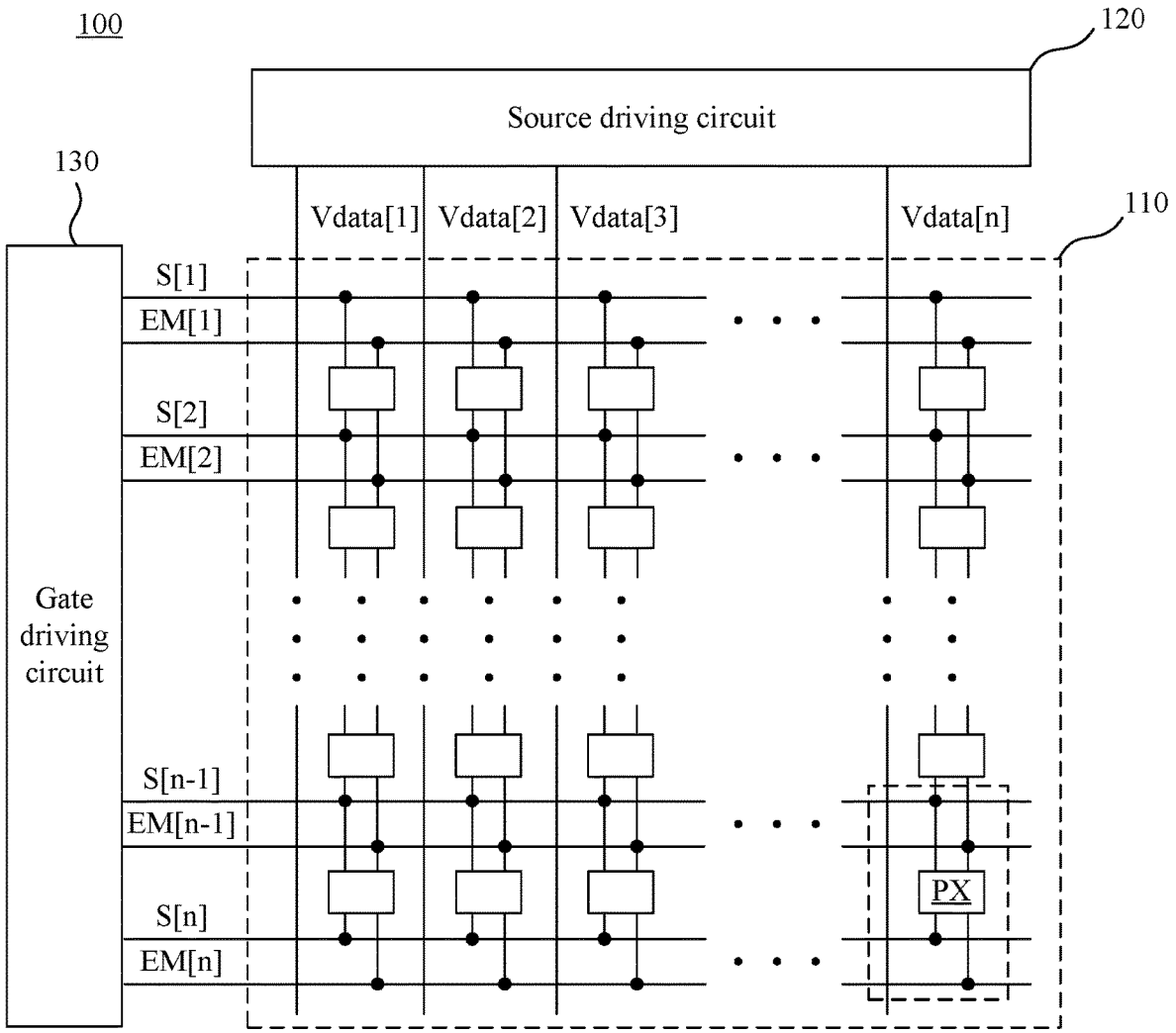
FIG. 1 is a simplified functional block diagram of a display device according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a simplified functional block diagram of a display device 100 according to one embodiment of the present disclosure. The display device 100 comprises a pixel array 110, in which the pixel array 110 comprises a plurality of pixel circuits PX. The display device 100 further comprises a source driving circuit 120 and a gate driving circuit 130. The source driving circuit 120 is configured to provide the data voltages Vdata[1]-Vdata[n] to the pixel array 110 via a plurality of data lines. The gate driving circuit 130 is configured to provide control signals S[1]-S[n] and emission signals EM[1]-EM[n] to the pixel array 110 via a plurality of gate lines. Each pixel circuit PX is disposed near by a cross point of one of the data lines and one of the gate lines, so as to receive corresponding ones of the control signals S[1]-S[n], corresponding ones of the emission signals EM[1]-EM[n], and a corresponding one of the data voltages Vdata[1]-Vdata[n], thereby performing operations such as data writing, characteristic compensation, and/or light emission.

In practice, the display device 100 may be implemented as an organic light-emitting diode (OLED) display or a Micro LED display.

Figure 2:
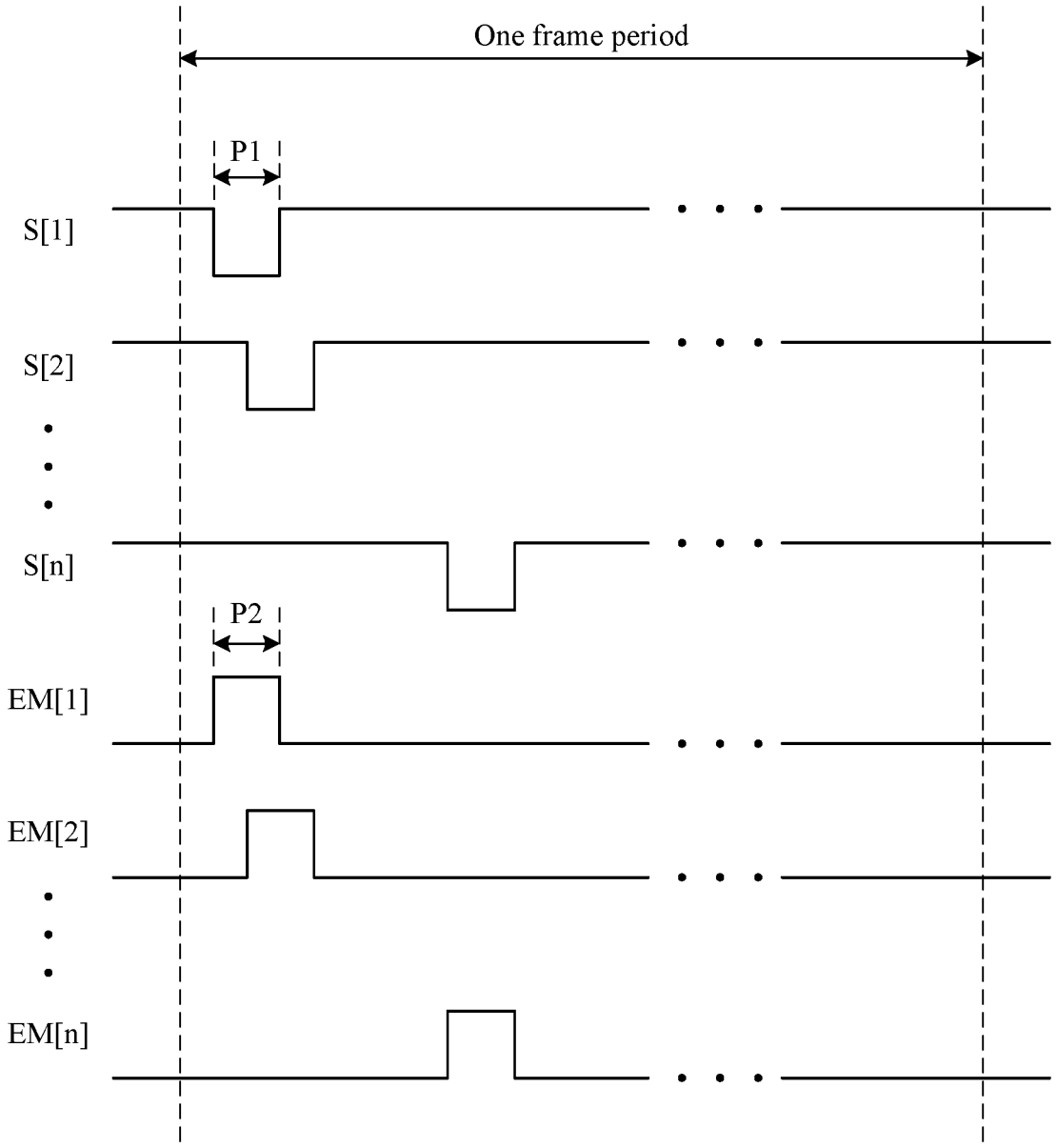
FIG. 2 is a simplified waveform schematic of control signals and the emission signals

FIG. 2 is a simplified waveform schematic of the control signals S[1]-S[n] and the emission signals EM[1]-EM[n]. As shown in FIG. 2, the control signals S[1]-S[n] are switched to a logic high level (e.g., a low voltage level) in sequence, and the control signals S[1]-S[n] are opposite to the emission signals EM[1]-EM[n], respectively. For example, the control signal S[1] is opposite to the emission signal EM[1]; the control signal S[2] is opposite to the emission signal EM[2]; the control signal S[n] is opposite to the emission signal EM[n], and so forth.

In one frame period, each of the control signals S[1]-S[n] is maintained at the logic high level for a time length (e.g., a time length P1), and each of the emission signals EM[1]-EM[n] is maintained at the logic low level for another time length (e.g., a time length P2). In some embodiments, in the frame period, the time length that any one of the control signals S[1]-S[n] having the logic high level would be the same as the time length that any one of the emission signals EM[1]-EM[n] having the logic low level, that is, the time length P1 is the same as the time length P2.

In other words, the control signals S[1]-S[n] and the emission signals EM[1]-EM[n] having simple waveforms contribute to a simple circuit structure of the gate driving circuit 130 so that the display device 100 can be implemented with a slim border. For example, the gate driving circuit 130 may comprise two different kinds of shift register circuits to respectively generates the control signals S[1]-S[n] and the emission signals EM[1]-EM[n], or the gate driving circuit 130 may comprise only one kind of shift register circuits having inverters to simultaneously generate control signals S[1]-S[n] and emission signals EM[1]-EM[n].

Figure 3:
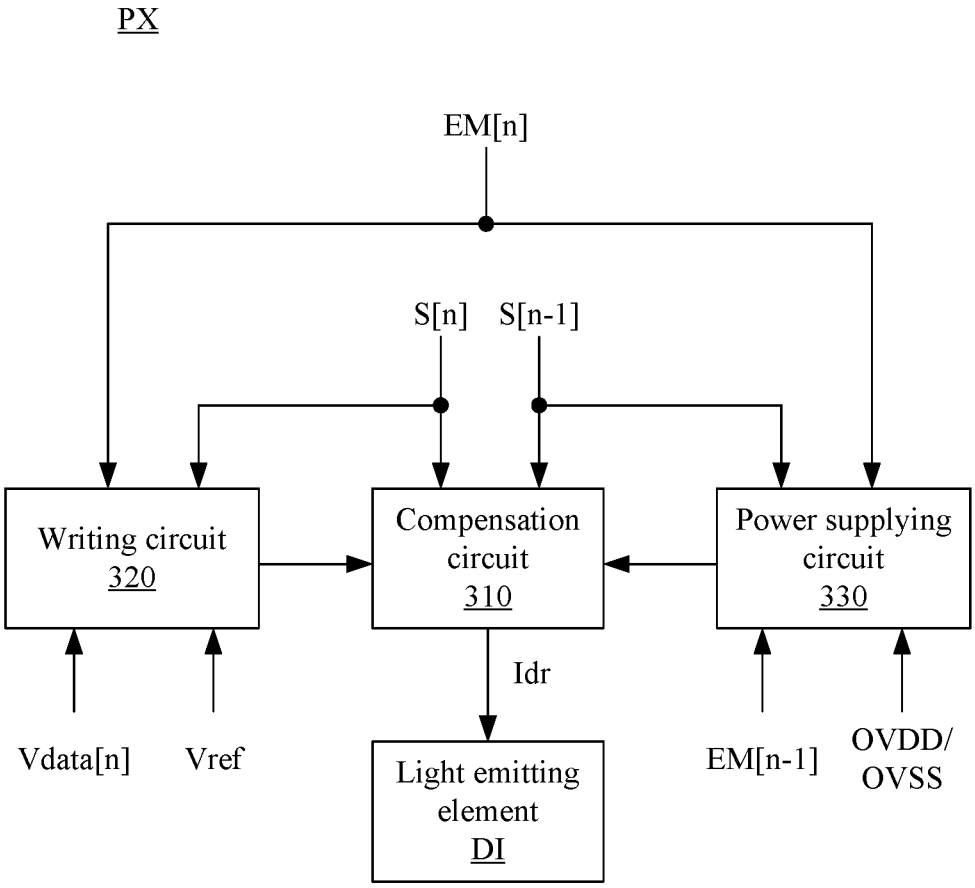
FIG. 3 is a simplified functional block diagram of a pixel circuit of FIG. 1 according to one embodiment of the present disclosure.

FIG. 3 is a simplified functional block diagram of the pixel circuit PX of FIG. 1 according to one embodiment of the present disclosure. For convenience of explanation, the pixel circuit PX of FIG. 3 is illustratively be the pixel circuit PX of FIG. 1 in which receives the control signal S[n−1], the control signal S[n], the emission signal EM[n−1], and the emission signal EM[n] (i.e., the one surrounded by dotted lines in FIG. 1). The pixel circuit PX comprises a compensation circuit 310, a writing circuit 320, a power supplying circuit 330, and a light emitting element DI. The compensation circuit 310 is configured to provide a driving current Idr to the light emitting element DI according to a voltage of a first node N1 (not shown in FIG. 3) in the compensation circuit 310 and also according to a system high voltage OVDD provided by the power supplying circuit 330, so that the light emitting element DI generates corresponding luminance.

The writing circuit 320 is configured to provide the data voltage Vdata[n] to the compensation circuit 310 according to the control signal S[n], and configured to provide the reference voltage Vref to the compensation circuit 310 according to the emission signal EM[n]. In some embodiments, the compensation circuit 310 sets the voltage of the first node N1 according to the data voltage Vdata[n] and the reference voltage Vref. The power supplying circuit 330 is configured to couple the compensation circuit 310 to the light emitting element DI according to the emission signal EM[n], and configured to provide the system high voltage OVDD to the compensation circuit 310 according to the emission signal EM[n−1]. In addition, the power supplying circuit 330 is further configured to provide a system low voltage OVSS to the compensation circuit 310 according to the control signal S[n−1], in which the compensation circuit 310 couples the first node N1 to the power supplying circuit 330 according to the control signal S[n] and the control signal S[n−1] so as to reset the voltage of the first node N1.

Notably, one pixel circuit PX of the display device 100 shares signals with other pixel circuits PX disposed at the adjacent rows to further reduce the circuit structure of the gate driving circuit 130. For example, the pixel circuit PX surrounded by the dotted lines of FIG. 1 shares the control signal S[n−1] and the emission signal EM[n−1] with other pixel circuits PX disposed at the adjacent rows.

Figure 4:
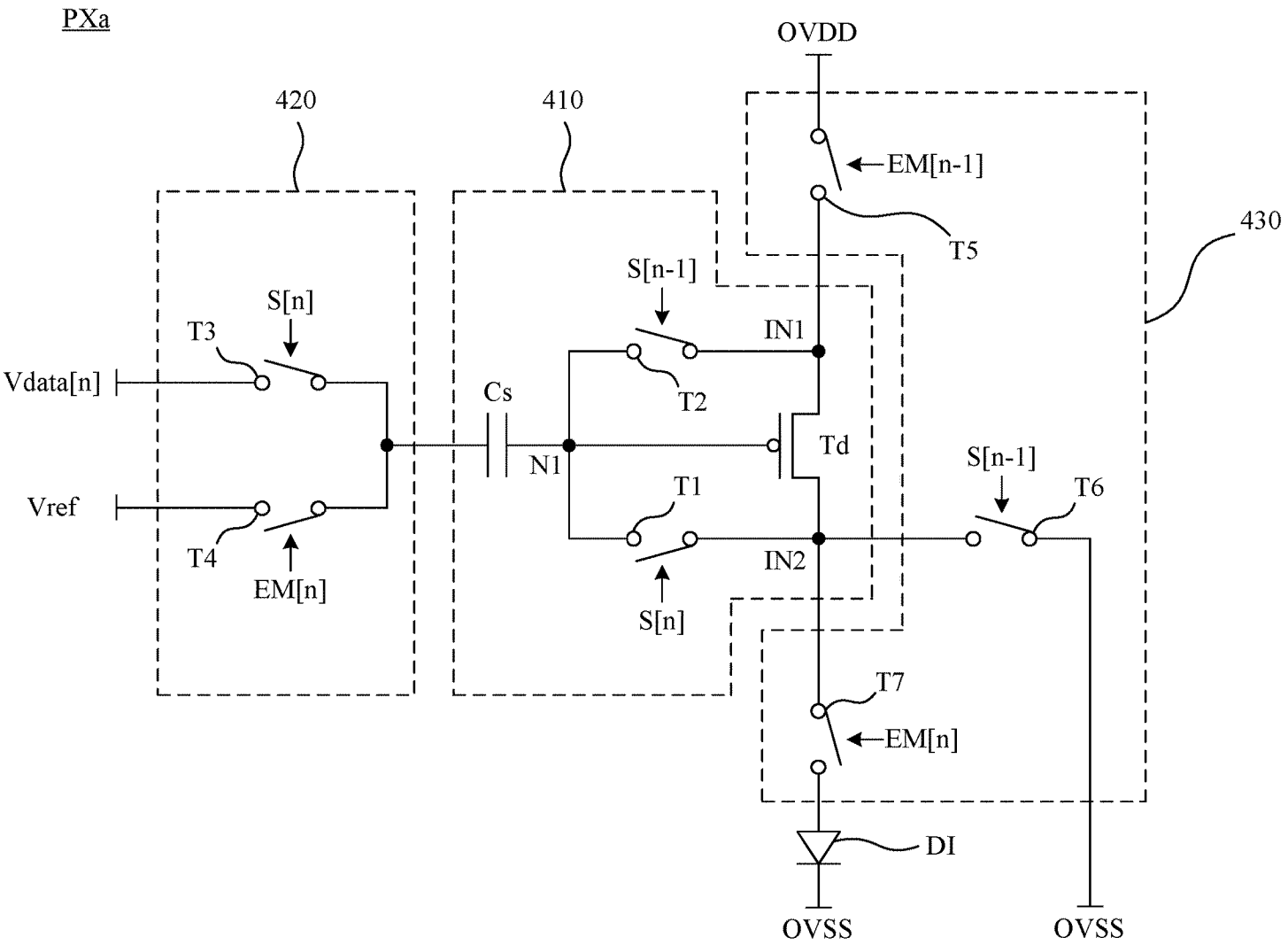
FIG. 4 is a schematic diagram of another pixel circuit according to one embodiment of the present disclosure.

FIG. 4 is a schematic diagram of a pixel circuit PXa according to one embodiment of the present disclosure. The pixel circuit PXa comprises a compensation circuit 410, a writing circuit 420, a power supplying circuit 430, and a light emitting element DI, in which a first terminal of the light emitting element DI is coupled with the compensation circuit 410, and a second terminal of the light emitting element DI is configured to receive the system low voltage OVSS.

In one embodiment, the compensation circuit 410 comprises a first input terminal IN1, a second input terminal IN2, a first node N1, and a driving transistor Td, in which a first terminal, a second terminal, and a control terminal of the driving transistor Td is coupled with a first input terminal IN1, a second input terminal IN2, and the first node N1, respectively. The first input terminal IN1 is configured to receive the system high voltage OVDD from the power supplying circuit 430. The second input terminal IN2 is configured to receive the system low voltage OVSS from the power supplying circuit 430, and is coupled with the light emitting element DI through the power supplying circuit 430.

When the power supplying circuit 430 provides the system high voltage OVDD, the compensation circuit 410 disconnects the first node N1 from the first input terminal IN1 and the second input terminal IN2 according to the control signal S[n] and the control signal S[n−1], in which the compensation circuit 410 further provides the driving current Idr to the light emitting element DI according to the voltage of the first node N1 and the system high voltage OVDD. In this situation, a voltage of the first input terminal IN1 is higher than the voltage of the first node N1, and the voltage of the first node N1 is higher than a voltage of the second input terminal IN2. As a result, a leakage current may flow from the first input terminal IN1 to the first node N1, and another leakage current may flow from the first node N1 to second input terminal IN2, so as to stabilize the voltage of the first node N1, which will be further described in the following paragraphs.

In another embodiment, the compensation circuit 410 further comprises a first switch T1, a second switch T2, and a storage capacitor Cs. A first terminal of the first switch T1 is coupled with the second input terminal IN2. A second terminal of the first switch T1 is coupled with the first node N1. A control terminal of the first switch T1 is configured to receive the control signal S[n]. A first terminal of the second switch T2 is coupled with the first input terminal IN1. A second terminal of the second switch T2 is coupled with the first node N1. A control terminal of the second switch T2 is configured to receive the control signal S[n−1]. A first terminal of the storage capacitor Cs is coupled with the first node N1, and a second terminal of the storage capacitor Cs is coupled with the writing circuit 420.

The compensation circuit 410 of each of the above embodiments may be used to realize the compensation circuit 310 of FIG. 3.

The writing circuit 420 is coupled with the compensation circuit 410, and comprises a third switch T3 and a fourth switch T4. A first terminal of the third switch T3 is coupled with the storage capacitor Cs. A second terminal of the third switch T3 is configured to receive the data voltage Vdata[n]. A control terminal of the third switch T3 is configured to receive the control signal S[n]. A first terminal of the fourth switch T4 is coupled with the storage capacitor Cs. A second terminal of the fourth switch T4 is configured to receive the reference voltage Vref. A control terminal of the fourth switch T4 is configured to receive the emission signal EM[n].

In one embodiment, the writing circuit 420 may be used to realize the writing circuit 320 of FIG. 3.

The power supplying circuit 430 comprises a fifth switch T5, a sixth switch T6, and a seventh switch T7. A first terminal of the fifth switch T5 is configured to receive the system high voltage OVDD. A second terminal of the fifth switch T5 is coupled with the first input terminal IN1 of the compensation circuit 310. A control terminal of the fifth switch T5 is configured to receive the emission signal EM[n−1]. A first terminal of the sixth switch T6 is configured to receive the system low voltage OVSS. A second terminal of the sixth switch T6 is coupled with the second input terminal IN2 of the compensation circuit 410. A control terminal of the sixth switch T6 is configured to receive the control signal S[n−1]. A first terminal of the seventh switch T7 is coupled with the second input terminal IN2. A second terminal of the seventh switch T7 is coupled with the first terminal of the light emitting element DI. A control terminal of the seventh switch T7 is configured to receive the emission signal EM[n].

In one embodiment, the power supplying circuit 430 may be used to realize the power supplying circuit 330 of FIG. 3.

In one embodiment, the pixel circuit PXa of FIG. 4 may be used to realize the pixel circuit PX of FIG. 1 and FIG. 3.

In practice, the switches and the driving transistor Td of the above embodiments may be realized by any suitable kinds of P-type transistors. For example, the thin-film transistors or the MOS field-effect transistor. The light emitting element DI may be realized by the OLED or the Micro LED.

Figure 5:
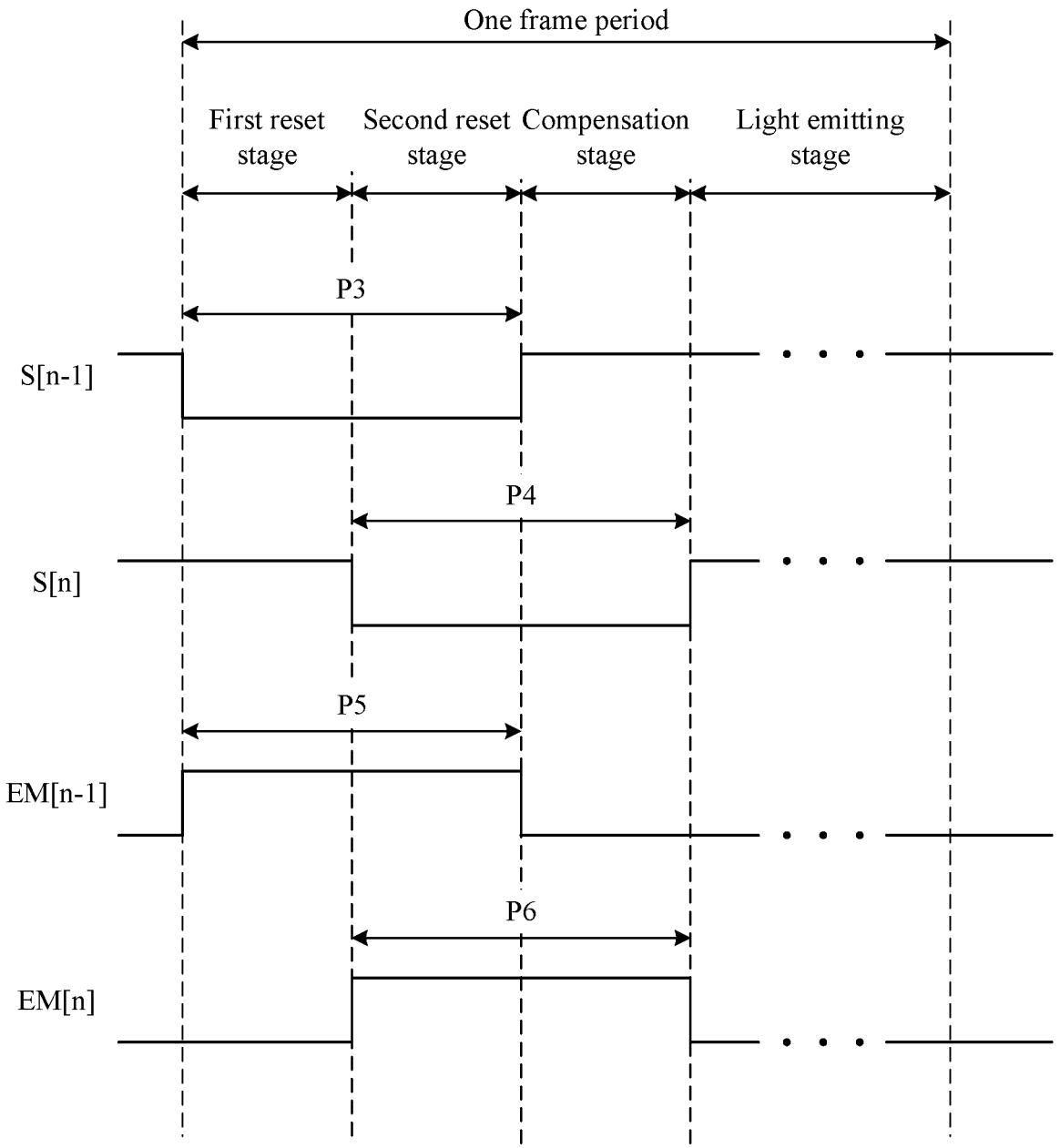
FIG. 5 is a simplified waveform schematic of the control signals and the emission signals inputted to the pixel circuit of FIG. 4.
Figure 6A:
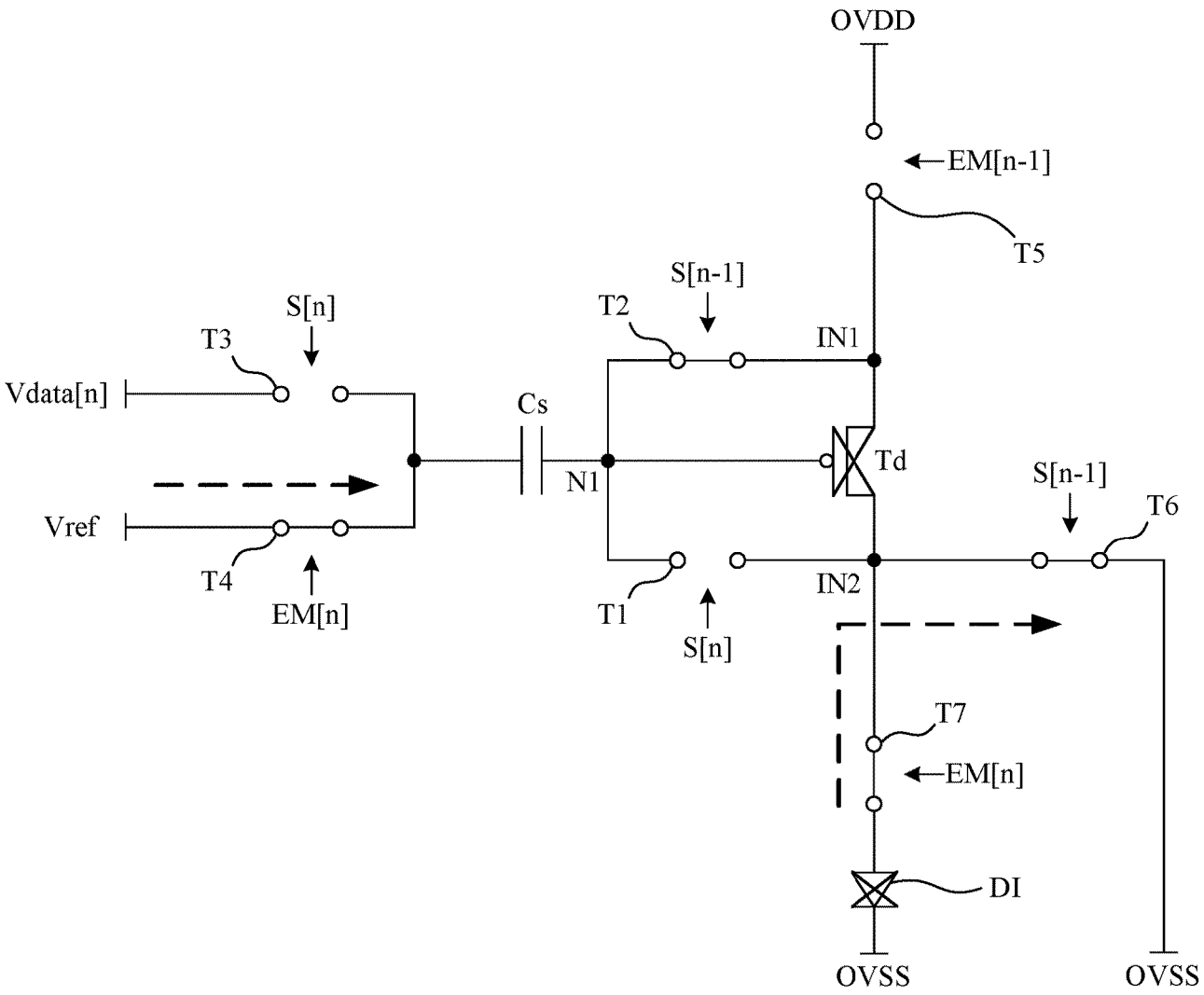
FIG. 6A is a schematic diagram for illustrating an equivalent circuit operation of the pixel circuit of FIG. 4 in a first reset stage.
Figure 6B:
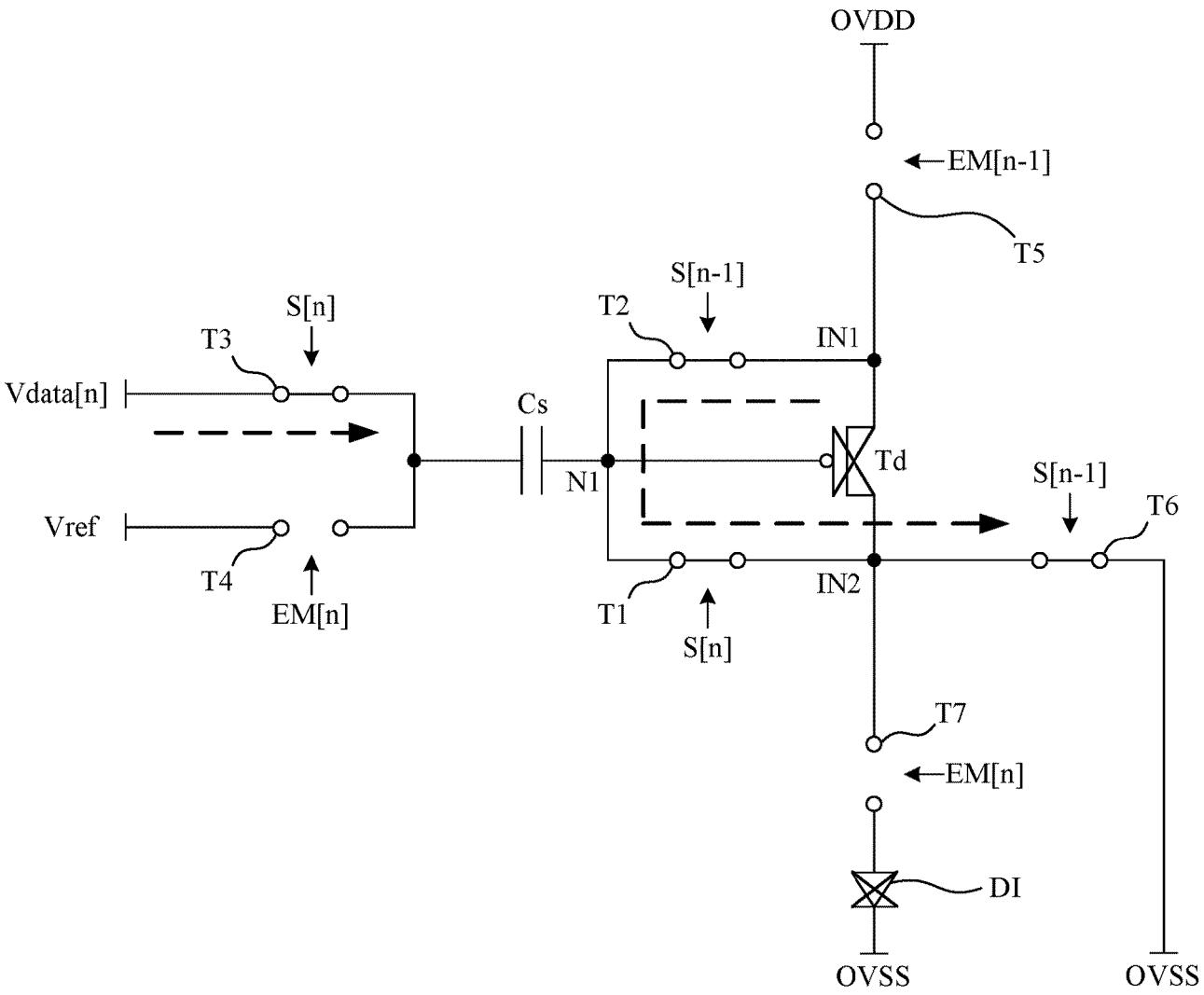
FIG. 6B is a schematic diagram for illustrating an equivalent circuit operation of the pixel circuit of FIG. 4 in a second reset stage.
Figure 6C:
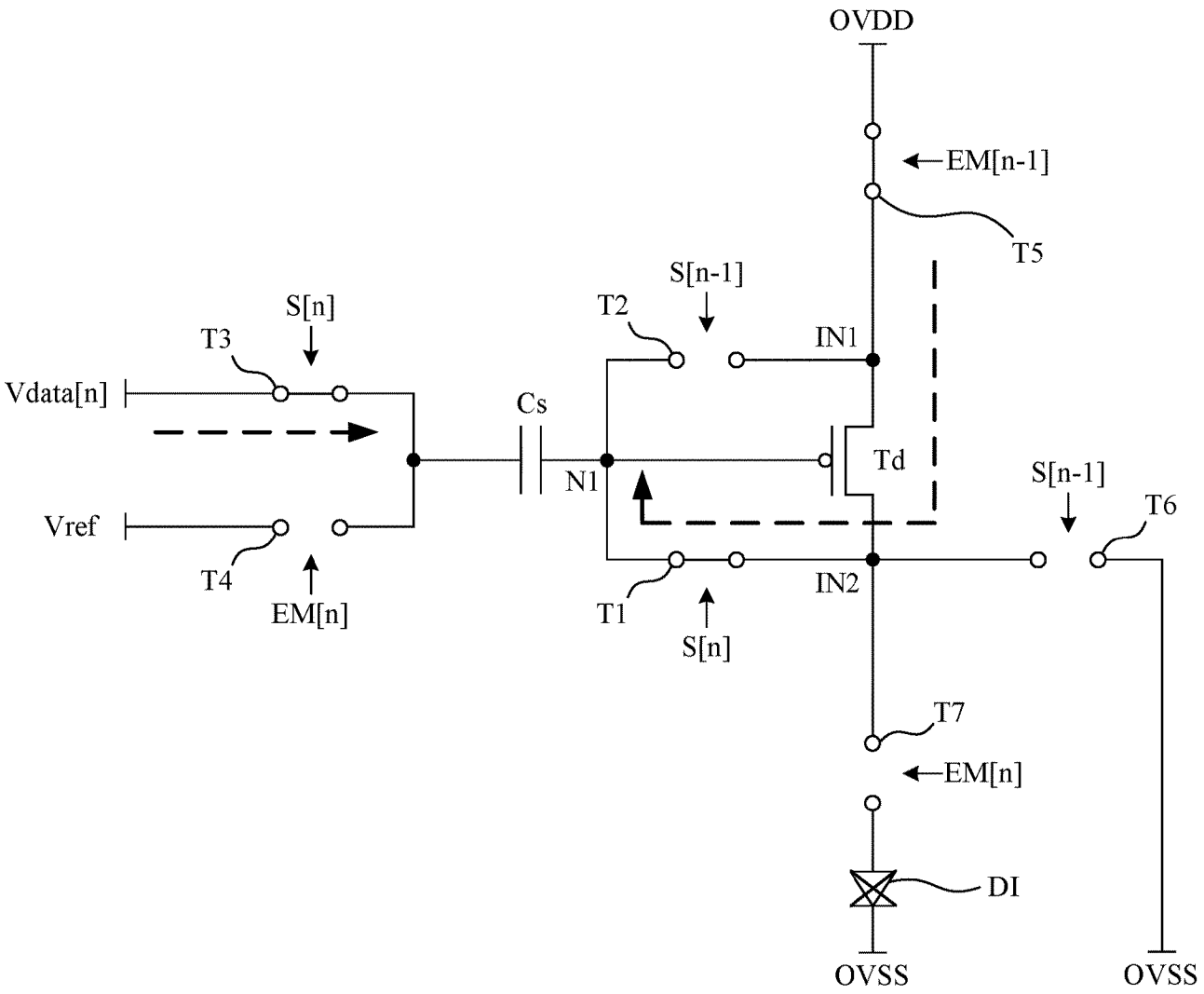
FIG. 6C is a schematic diagram for illustrating an equivalent circuit operation of the pixel circuit of FIG. 4 in a compensation stage.
Figure 6D:
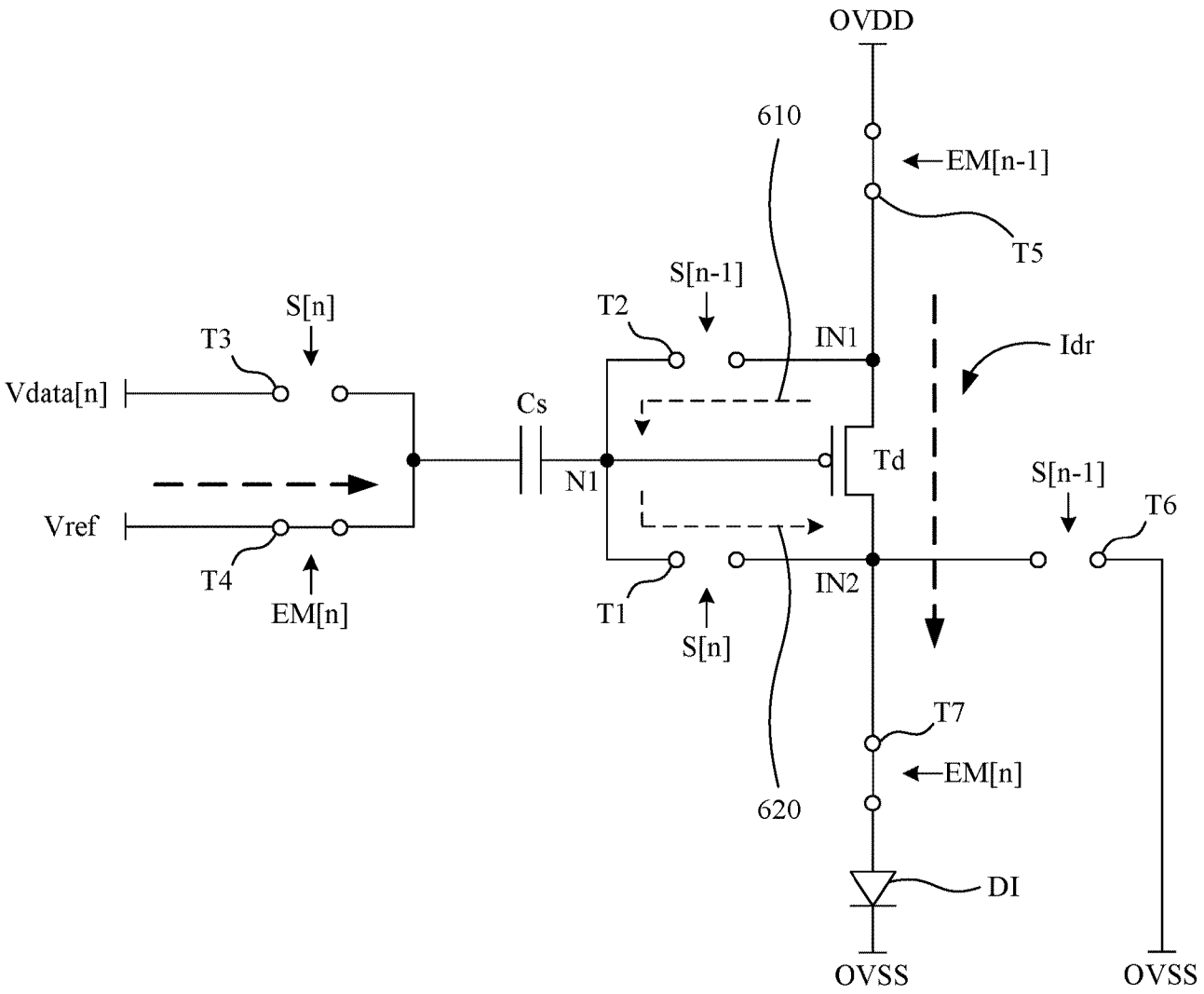
FIG. 6D is a schematic diagram for illustrating an equivalent circuit operation of the pixel circuit of FIG. 4 in a light emitting stage.

FIG. 5 is a simplified waveform schematic of the control signal S[n], the control signal S[n−1], the emission signal EM[n], and the emission signal EM[n−1] inputted to the pixel circuit PXa. FIG. 6A is a schematic diagram for illustrating an equivalent circuit operation of the pixel circuit PXa in a first reset stage. FIG. 6B is a schematic diagram for illustrating an equivalent circuit operation of the pixel circuit PXa in a second reset stage. FIG. 6C is a schematic diagram for illustrating an equivalent circuit operation of the pixel circuit PXa in a compensation stage. FIG. 6D is a schematic diagram for illustrating an equivalent circuit operation of the pixel circuit PXa in a light emitting stage.

As shown in FIG. 5, in one frame period, a time length P3 in which the control signal S[n−1] having the logic high level (e.g., the low voltage level) is the same as a time length P4 in which the control signal S[n] having the logic high level. A time length P5 in which the emission signal EM[n−1] having the logic low level (e.g., the high voltage level) is the same as a time length P6 in which the emission signal EM[n] having the logic low level. In another embodiment, in one frame period, the time length P3, the time length P4, the time length P5, and the time length P6 are the same.

Reference is made to FIG. 5 and FIG. 6A. In the first reset stage, the control signal S[n−1] and the emission signal EM[n] have the logic high level, while the control signal S[n] and the emission signal EM[n−1] have the logic low level. Therefore, the second switch T2, the fourth switch T4, and the sixth switch T6 are conducted, while other switches of the pixel circuit PXa are switched off, so that the first terminal of the light emitting element DI is set to the system low voltage OVSS to substantially completely switch off the light emitting element DI to improve the contrast ratio.

Reference is made to FIG. 5 and FIG. 6B. In the second reset stage, the control signal S[n] and the control signal S[n−1] have the logic high level, while the emission signal EM[n] and the emission signal EM[n−1] have the logic low level. Therefore, the first switch T1, the second switch T2, the third switch T3, and the sixth switch T6 are conducted, while other switches of the pixel circuit PXa are switched off so that the first input terminal IN1, the second input terminal IN2, and the first node N1 are set to system low voltage OVSS. In addition, the writing circuit 420 maintains the second terminal of the storage capacitor Cs at the data voltage Vdata[n] during the second reset stage.

Reference is made to FIG. 5 and FIG. 6C. In the compensation period, the control signal S[n] and the emission signal EM[n−1] have the logic high level, and the control signal S[n−1] and the emission signal EM[n] have the logic low level. Therefore, the first switch T1, the third switch T3, the fifth switch T5, and the driving transistor Td are conducted, while other switches of the pixel circuit PXa are switched off. The compensation circuit 410 detects the threshold voltage of the driving transistor Td to generate a detection result, and stores the detection result at the first node N1. In addition, the writing circuit 420 maintains the second terminal of the storage capacitor Cs at the data voltage Vdata[n] during the compensation period.

Specifically, the voltage of the first node N1 during the compensation period may be calculated by the following Formula 1:

$$V1=OVDD-|Vth| \quad \text{(Formula 1)}$$

The symbol "V1" represents the voltage of the first node N1, and the symbol "Vth" represents the threshold voltage of the driving transistor Td.

Reference is made to FIG. 5 and FIG. 6D. In the emission period, the control signal S[n] and the control signal S[n−1] have the logic low level, while the emission signal EM[n] and the emission signal EM[n−1] have the logic high level. Therefore, the fourth switch T4, fifth switch T5, the seventh switch T7, and the driving transistor Td are conducted, while other switches of the pixel circuit PXa are switched off. The power supplying circuit 430 provides the system high voltage OVDD to the first input terminal IN1, and also couples the second input terminal IN2 to the light emitting element DI. The writing circuit 420 provides the reference voltage Vref to the second terminal of the storage capacitor Cs, so that the voltage of the first node N1 is changed because of the capacitive coupling effect of the storage capacitor Cs.

Specifically, the voltage of the first node N1 during the emission stage may be described by the following Formula 2:

$$V1 = OVDD - |Vth| + (Vref - Vdata) \quad \text{(Formula 2)}$$

In addition, the driving transistor Td is operated in the saturation region, and provides the driving current Idr according to the voltage of the first node N1 and the system high voltage OVDD. The driving current Idr during emission stage may be described by the following Formula 3:

$$Idr = \frac{1}{2}k(OVDD - V1 - |Vth|)^2 = \frac{1}{2}k(Vdata[n] - Vref)^2 \quad \text{(Formula 3)}$$

The symbol "k" represents a product of carrier mobility, gate oxide capacitance per unit area, and a width-to-length ratio of the driving transistor Td.

As can be appreciated from Formula 3, even if the threshold voltage of the driving transistor Td varies because of multiple reasons such as the manufacture processes and the degradation, or if the system high voltage OVDD varies because of the current-resistor drop (IR drop) effect, a normal relationship remains between the magnitude of the driving current Idr and the data voltage Vdata[n].

On the other hand, as shown in FIG. 6D, the first input terminal IN1 leaks to the first node N1 to supplement charge lost due to the leakage from the first node N1 to the second input terminal IN2. For example, the first node N1 gains charges through a current path 610 to supplement the charges losing form first node N1 through the current path 620. Therefore, the pixel circuit PXa is capable of providing the stable driving current Idr during one frame.

The switches of the above embodiments may be realized by any suitable kinds of N-type transistors. In these implementations, the waveforms of the control signal S[n], the control signal S[n−1], the emission signal EM[n], and the emission signal EM[n−1] are respectively opposite to that of the corresponding signals of FIG. 5.

Figure 7A:
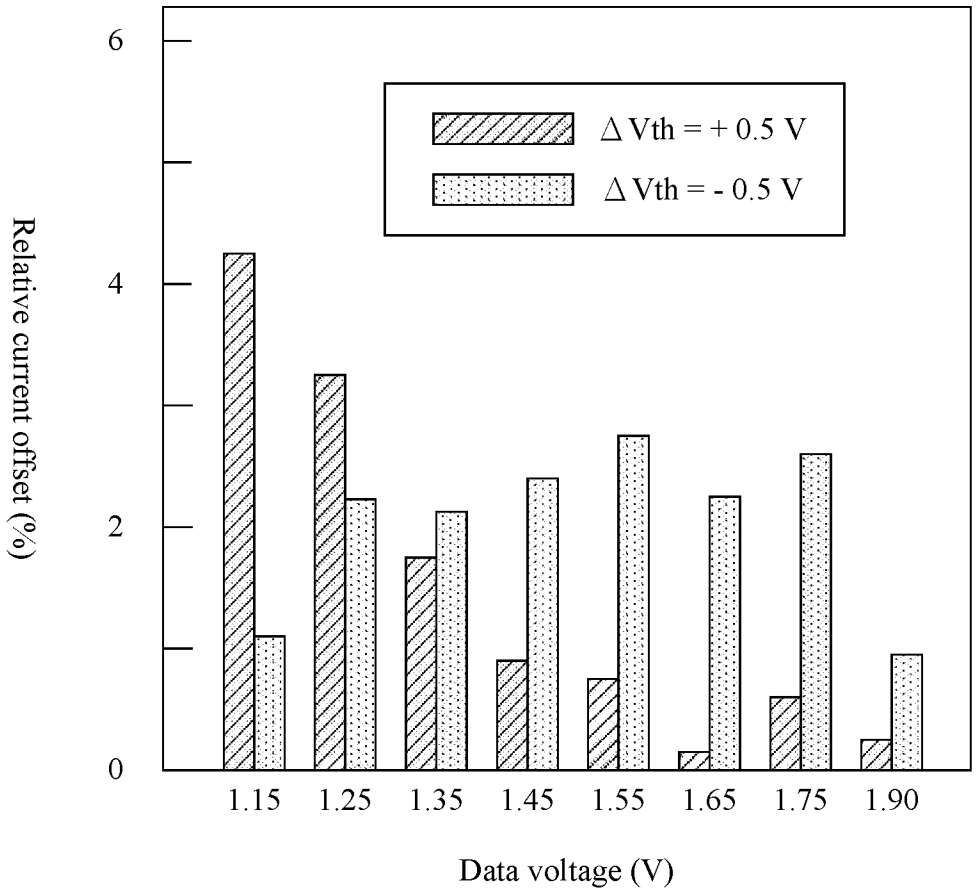
FIG. 7A shows an illustrative compensation result regard to the threshold voltage variation of the pixel circuit of FIG. 4.

FIG. 7A shows an illustrative compensation result regard to the threshold voltage variation of the pixel circuit PXa of FIG. 4. As shown in FIG. 7A, when the data voltage Vdata[n] is in a range from low to high gray level (e.g., 0 to 255 gray level), the driving current Idr differs from an ideal value for less than 5%, despite the threshold voltage of the driving transistor Td having a variation of 0.5 V or −0.5 V.

Figure 7B:
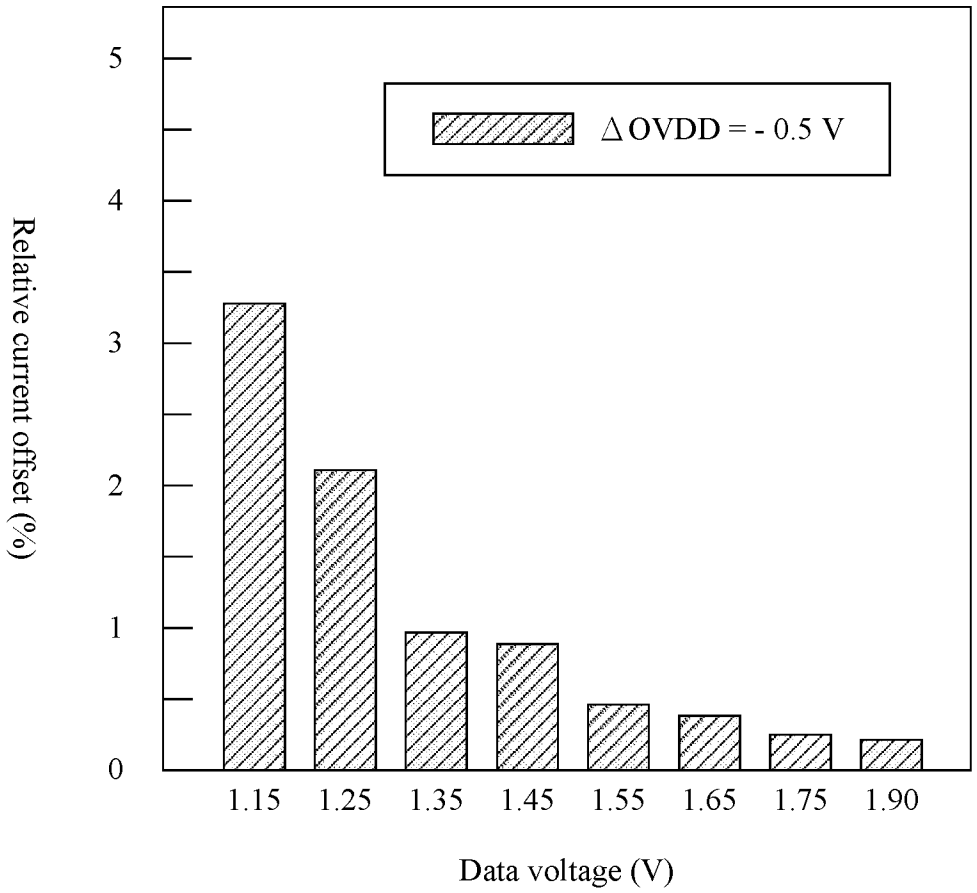
FIG. 7B is an illustrative compensation result regard to the current-resistor drop (IR drop) of the pixel circuit of FIG. 4.

FIG. 7B is an illustrative compensation result regard to the IR drop of the pixel circuit PXa of FIG. 4. As shown in FIG. 7B, when the data voltage Vdata[n] is in a range from low to high gray level (e.g., 0 to 255 gray level), the driving current Idr differs from the ideal value for less than 3.5%, despite the system high voltage OVDD having a variation of −0.5 V. The aforesaid "ideal value" means a magnitude that the driving current Idr should have in a situation that the threshold voltage Vth and the system high voltage OVDD have no variations.

In addition, as shown in Table 1, in the cases respectively corresponding to the low, medium and high gray levels, the voltage of the first node N1 varies for less than 3% during the emission stage.

TABLE 1

| | Voltage of first node at beginning of emission stage | Voltage of first node at end of emission stage |
|---|---|---|
| Low gray level (Idr = 0.59 nA) | 2.191 V | 2.128 V |
| Medium gray level (Idr = 51.1 nA) | 1.651 V | 1.655 V |
| High gray level (Idr = 103.8 nA) | 1.453 V | 1.484 V |

Figure 8:
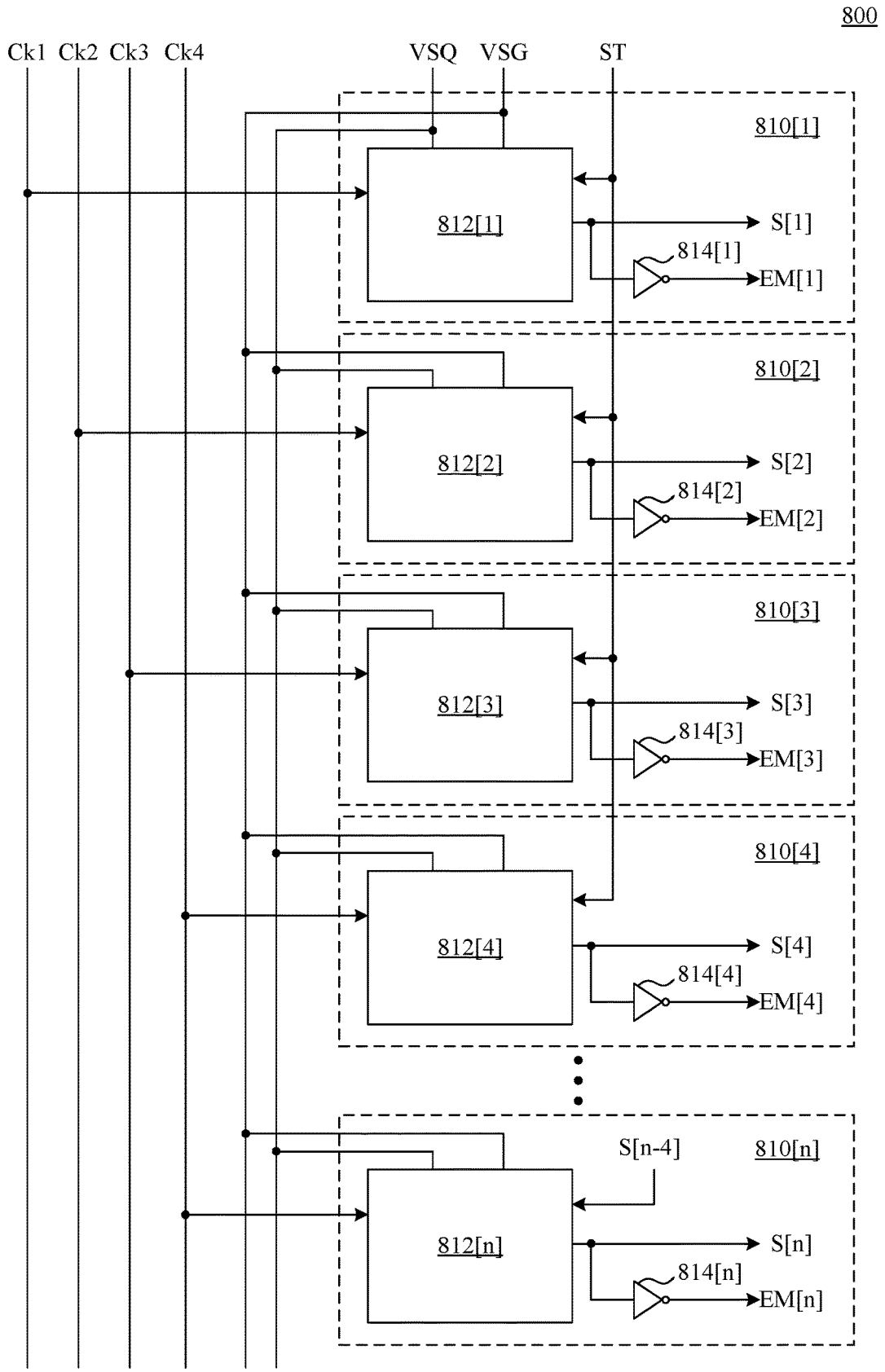
FIG. 8 is a simplified functional block diagram of a gate driving circuit according to one embodiment of the present disclosure.

FIG. 8 is a simplified functional block diagram of a gate driving circuit 800 according to one embodiment of the present disclosure. The gate driving circuit 800 comprises a plurality of stages of shift register circuits 810[1]-810[n]. The shift register circuits 810[1]-810[n] are configured to provide the control signals S[1]-S[n], respectively, and also configured to provide the emission signals EM[1]-EM[n], respectively.

The shift register circuits 810[1]-810[n] are configured to perform shift register operations according to clock signals Ck1-Ck4 and a start signal ST, so as to output the control signals S[1]-S[n] and/or the emission signals EM[1]-EM[n] having the logic high level. The shift register circuits 810[1]-810[n] are also configured to stabilize the control signals S[1]-S[n] and/or the emission signals EM[1]-EM[n] at the logic low level according to the power input VSQ and the power input VSG.

In one embodiment, the gate driving circuit 800 can be used to realize the gate driving circuit 130 of FIG. 1.

As shown in FIG. 8, the shift register circuits 810[1]-810[n] respectively comprise shift register units 812[1]-812[n], and respectively comprise inverters 814[1]-814[n]. The shift register units 812[1]-812[n] are configured to provide the control signals S[1]-S[n], respectively. The inverters 814[1]-814[n] are coupled with the shift register units 812[1]-812[n], respectively, and are configured to provide the emission signals EM[1]-EM[n], respectively, according to the control signals S[1]-S[n].

For example, the shift register unit 812[1] outputs the control signal S[1] to the inverter 814[1], while the inverter 814[1] outputs the emission signal EM[1] opposite to the control signal S[1]. As another example, the shift register unit 812[2] outputs the control signal S[2] to the inverter 814[2], while the inverter 814[2] outputs the emission signal EM[2] opposite to the control signal S[2].

In another embodiment, the shift register units 812[1]-812[n] are configured to provide the emission signals EM[1]-EM[n], respectively. The inverters 814[1]-814[n] are configured to provide the control signals S[1]-S[n], respectively, according to the emission signals EM[1]-EM[n].

In other words, since the gate driving circuit 800 provides signals having different waveforms despite the simple circuit structure thereof, the gate driving circuit 800 is suitable for slim-border displays.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

The term "and/or" may comprise any and all combinations of one or more of the associated listed items. In addition, the singular forms "a," "an," and "the" herein are intended to comprise the plural forms as well, unless the context clearly indicates otherwise.

Other embodiments of the present disclosure will be apparent to those skilled in the art from consideration of the specification and practice of the present disclosure disclosed herein. It is intended that the specification and examples be considered as exemplary only, with a true scope and spirit of the present disclosure being indicated by the following claims.

What is claimed is:

1. A pixel circuit, comprising:

a compensation circuit, comprising a first node, and configured to provide a driving current according to a voltage of the first node and a system high voltage;

a writing circuit, configured to provide a data voltage to the compensation circuit according to a first control signal so that the compensation circuit sets the voltage of the first node;

a light emitting element, configured to emit light according to the driving current; and a power supplying circuit, configured to couple the compensation circuit to the light emitting element according to a first emission signal, configured to provide the system high voltage to the compensation circuit according to a second emission signal, and configured to provide a system low voltage to the compensation circuit according to a second control signal to reset the voltage of the first node, wherein the first control signal is opposite to the first emission signal, and the second control signal is opposite to the second emission signal, wherein in a frame period, a time length in which the first control signal having a logic high level is same as a time length in which the second control signal having the logic high level, and a time length in which the first emission signal having a logic low level is same as a time length in which the second emission signal having the logic low level.

2. The pixel circuit of claim 1, wherein in the frame period, the time length in which the first control signal having the logic high level, the time length in which the second control signal having the logic high level, the time length in which first emission signal having the logic low level, and the time length in which the second emission signal having the logic low level are same as each other.

3. The pixel circuit of claim 1, wherein the compensation circuit further comprises:

a first input terminal, configured to receive the system high voltage;

a second input terminal, configured to receive the system low voltage; and a driving transistor, comprising a first terminal, a second terminal, and a control terminal, wherein the first terminal of the driving transistor is coupled with the first input terminal, the second terminal of the driving transistor is coupled with the second input terminal, and the control terminal of the driving transistor is coupled with the first node, wherein if the power supplying circuit provides the system high voltage to the compensation circuit, the compensation circuit disconnects the first node from the first input terminal and from the second input terminal, in which a leakage current flows from the first input terminal to the first node, and another leakage current flows from the first node to the second input terminal, so as to stabilized the voltage of the first node.

4. The pixel circuit of claim 1, wherein the compensation circuit further comprises:

a first input terminal, configured to receive the system high voltage;

a second input terminal, configured to receive the system low voltage;

a driving transistor, comprising a first terminal, a second terminal, and a control terminal, wherein the first terminal of the driving transistor is coupled with the first input terminal, the second terminal of the driving transistor is coupled with the second input terminal, and the control terminal of the driving transistor is coupled with the first node;

a first switch, comprising a first terminal, a second terminal, and a control terminal, wherein the first terminal of the first switch is coupled with the second input terminal, the second terminal of the first switch is coupled with the first node, and the control terminal of the first switch is configured to receive the first control signal;

a second switch, comprising a first terminal, a second terminal, and a control terminal, wherein the first terminal of the second switch is coupled with the first input terminal, the second terminal of the second switch is coupled with the first node, and the control terminal of the second switch is configured to receive the second control signal; and a storage capacitor, coupled between the first node and the writing circuit.

5. The pixel circuit of claim 1, wherein the writing circuit comprises:

a third switch, comprising a first terminal, a second terminal, and a control terminal, wherein the first terminal of the third switch is coupled with the compensation circuit, the second terminal of the third switch is configured to receive the data voltage, and the control terminal of the third switch is configured to receive the first control signal; and a fourth switch, comprising a first terminal, a second terminal, and a control terminal, wherein the first terminal of the fourth switch is coupled with the compensation circuit, the second terminal of the fourth switch is configured to receive a reference voltage, and the control terminal of the fourth switch is configured to receive the first emission signal.

6. The pixel circuit of claim 1, wherein the power supplying circuit comprises:

a fifth switch, comprising a first terminal, a second terminal, and a control terminal, wherein the first terminal of the fifth switch is configured to receive the system high voltage, the second terminal of the fifth switch is coupled with the compensation circuit, and the control terminal of the fifth switch is configured to receive the second emission signal;

a sixth switch, comprising a first terminal, a second terminal, and a control terminal, wherein the first terminal of the sixth switch is configured to receive the system low voltage, the second terminal of the sixth switch is coupled with the compensation circuit, and the control terminal of the sixth switch is configured to receive the second control signal; and a seventh switch, comprising a first terminal, a second terminal, and a control terminal, wherein the first terminal of the seventh switch is coupled with the compensation circuit, the second terminal of the seventh switch is coupled with the light emitting element, and the control terminal of the seventh switch is configured to receive the first emission signal.

7. A display device, comprising:

a gate driving circuit, configured to provide a plurality of control signals and a plurality of emission signals, wherein the plurality of control signals are opposite to the plurality of emission signals, respectively;

a pixel array, coupled with the gate driving circuit, and comprising a plurality of pixel circuits, wherein each of the plurality of pixel circuits comprises:

a compensation circuit, comprising a first node, and configured to provide a driving current according to a voltage of the first node and a system high voltage;

a writing circuit, configured to provide a data voltage to the compensation circuit according to a first control signal of the plurality of control signals, so that the compensation circuit sets the voltage of the first node;

a light emitting element, configured to emit lights according to the driving current; and a power supplying circuit, configured to conduct the compensation circuit to the light emitting element according to a first emission signal of the plurality of emission signals, configured to provide the system high voltage to the compensation circuit according to a second emission signal of the plurality of emission signals, and configured to provide a system low voltage to the compensation circuit according to a second control signal of the plurality of control signals so as to reset the voltage of the first node; and a source driving circuit, coupled with the pixel array, and configured to provide the data voltage, wherein in a frame period, a time length in which the first control signal having a logic high level is same as a time length in which the second control signal having the logic high level, and a time length in which the first emission signal having a logic low level is same as a time length in which the second emission signal having the logic low level.

8. The display device of claim 7, wherein the gate driving circuit comprises a plurality of stages of shift register circuits, and each of the plurality of stages of shift register circuits comprises:

a shift register unit, configured to provide one of followings: a corresponding one of the plurality of control signals and a corresponding one of the plurality of emission signals; and an inverter, coupled with the shift register unit, wherein if the shift register unit provides the corresponding one of the plurality of control signals, the inverter provides the corresponding one of the plurality of emission signals according to the corresponding one of the plurality of control signals, wherein if the shift register unit provides the corresponding one of the plurality of emission signals, the inverter provides the corresponding one of the plurality of control signals according to the corresponding one of the plurality of emission signals.

* * * * *